US012171342B2

(12) United States Patent
Schröder

(10) Patent No.: US 12,171,342 B2
(45) Date of Patent: Dec. 24, 2024

(54) CHAIR AND JOINT SYSTEM FOR A CHAIR OR A SEATING APPARATUS

(71) Applicant: aeris GmbH, Haar bei München (DE)

(72) Inventor: Thomas Hermann Schröder, Beaumont, TX (US)

(73) Assignee: aeris GmbH, Haar bei München (DE)

( * ) Notice: Subject to any disclaimer, the term of this patent is extended or adjusted under 35 U.S.C. 154(b) by 71 days.

(21) Appl. No.: 17/922,573

(22) PCT Filed: Jan. 12, 2021

(86) PCT No.: PCT/EP2021/050469

§ 371 (c)(1),
(2) Date: Oct. 31, 2022

(87) PCT Pub. No.: WO2021/259522

PCT Pub. Date: Dec. 30, 2021

(65) Prior Publication Data

US 2023/0263308 A1 Aug. 24, 2023

(30) Foreign Application Priority Data

Jun. 24, 2020 (DE) ..... 10 2020 116 642.7

(51) Int. Cl.
*A47C 3/02* (2006.01)
*A47C 3/24* (2006.01)
(Continued)

(52) U.S. Cl.
CPC ..... *A47C 3/245* (2013.01); *A47C 3/026* (2013.01); *A47C 7/004* (2013.01); *A47C 9/002* (2013.01); *A47C 9/025* (2013.01)

(58) Field of Classification Search
CPC ..... A47C 3/245; A47C 3/026; A47C 9/002; A47C 9/025; A47C 7/004
See application file for complete search history.

(56) References Cited

U.S. PATENT DOCUMENTS 5,921,628 A 7/1999 Glockl
5,921,926 A 7/1999 Rolland et al.
(Continued)

FOREIGN PATENT DOCUMENTS

DE 4244657 A1 10/1993
DE 10338549 A1 3/2005
(Continued)

OTHER PUBLICATIONS

International Search Report dated Mar. 18, 2021, which issued in the corresponding PCT Patent Application No. PCT/EP2021/050469, including English translation.

*Primary Examiner* — Syed A Islam
(74) *Attorney, Agent, or Firm* — Dickinson Wright PLLC

(57) ABSTRACT

Joint arrangement (10) has a hollow cylindrical receiving cylinder (20) that extends in a cylinder axis direction (Z) and receives one end of a chair column (30) of an active-dynamic wobble chair, the latter movably mounted in a substantially hollow cylindrical outer joint shell (40) composed of joint shell segments (45). Movable mounting of receiving cylinder (20) is achieved by deformable elastic elements (50) arranged to be variable in shape and position in a bearing gap (60) between an outer wall portion (21, 22) of the receiving cylinder (20) and an inner wall portion (41, 42) of the joint shell (40). Receiving cylinder (20) is actuated in a force-dependent manner, whereby shape and/or position of the elastic elements (50) change as viewed in a radial direction (Rs) from changing, preferably reducing, clearance of the bearing gap (60) when the receiving cylinder (20) is actuated in a cylinder axis direction (Z).

11 Claims, 4 Drawing Sheets

(51) Int. Cl.

| | |
|---|---|
| *A47C 3/026* | (2006.01) |
| *A47C 7/00* | (2006.01) |
| *A47C 9/00* | (2006.01) |
| *A47C 9/02* | (2006.01) |

(56) References Cited

U.S. PATENT DOCUMENTS

| | | | | |
|---|---|---|---|---|
| 6,209,958 | B1 | 4/2001 | Thole | |
| 6,305,674 | B1 * | 10/2001 | Koivurova | A63G 13/00 267/141 |
| 6,601,818 | B1 * | 8/2003 | Larsen | A47C 9/002 267/141.5 |
| 10,772,432 | B2 * | 9/2020 | Park | A47C 7/5064 |
| 2008/0143162 | A1 | 6/2008 | Glockl | |

FOREIGN PATENT DOCUMENTS

| | | | |
|---|---|---|---|
| DE | 102009019880 | A1 | 1/2011 |
| EP | 0808116 | B1 | 12/1999 |

* cited by examiner

CHAIR AND JOINT SYSTEM FOR A CHAIR OR A SEATING APPARATUS

FIELD

The disclosure relates to a chair and joint system for a chair or a seating apparatus.

BACKGROUND

A variety of chairs and seating systems exist which can typically be divided into three parts: a floor-level base portion (base or a support), an intermediate portion (e.g., multiple legs or a chair column), and an upper, seat portion (seat or seat part). Traditionally, most chairs, stools, or seats have a rigid connection for the two interfaces between the base, the intermediate portion, and the seat. Recent developments have provided a flexible connection for at least one of these interfaces with an associated return mechanism.

SUMMARY

Example embodiments of the present disclosure provide an active-dynamic chair in which the seat user can perform safe and varied movements of the seat part in a defined range of motion and the pendulum joint is inexpensive to manufacture and has a long service life.

This advantageous aspect of the example embodiments is achieved by the combination of features according to claim 1, for example.

According to an example embodiment, a joint arrangement comprises a hollow cylindrical receiving cylinder that extends in the cylinder axis direction and is designed to receive one end of a chair column of an active-dynamic wobble chair, the latter being movably mounted in a substantially hollow cylindrical outer joint shell that is composed of two or more parts made up of joint shell segments, the movable mounting of the receiving cylinder being achieved by means of deformable elastic elements that are arranged so as to be variable in shape and position in a bearing gap between an outer wall portion of the receiving cylinder and an inner wall portion of the joint shell and the receiving cylinder can be actuated in a force-dependent manner, which changes the shape and/or position of the elastic elements as viewed in a radial direction as a result of a change, preferably a reduction, in the clearance of the bearing gap when the receiving cylinder is actuated in a cylinder axis direction.

An example embodiment of a joint arrangement is advantageous in which the movable mounting of the receiving cylinder is achieved by means of deformable elastic elements which are respectively arranged so as to be variable in shape and position in the bearing gap between a conically tapering outer wall portion of the receiving cylinder and a conically tapering inner wall portion of the joint shell and the receiving cylinder can be actuated in a force-dependent manner in a cylinder axis direction, which changes the shape and/or position of the elastic elements as a result of a reduction in the clearance of the bearing gap as viewed in a radial direction (Rs), particularly along the entire circumference. In accordance with another advantageous aspect of an example embodiment, an outer wall of the receiving cylinder has at least one first upper and one second lower wall portion, which are offset in the cylinder axis direction and each of which tapers conically, and that there is preferably a radially constricted wall portion with a smaller diameter between the two wall portions which, preferably as seen in a longitudinal section through the receiving cylinder, has a concave shape.

In accordance with another advantageous aspect of an example embodiment, the outer wall of the receiving cylinder is also provided at the lower end of the upper concave wall portion with a projection which extends radially outward in the direction of the bearing gap and extends partially or completely around along the outer wall in the circumferential direction and against which abuts an elastic element that is arranged in this region in the bearing gap.

In accordance with another advantageous aspect of an example embodiment, the outer wall of the receiving cylinder is provided at the lower end of the lower concave wall portion with a projection which extends radially outward in the direction of the bearing gap and which extends partially or completely around along the outer wall in the circumferential direction and against which abuts an elastic element that is arranged in this region in the bearing gap.

In accordance with another advantageous aspect of an example embodiment, the inner wall of the hollow cylindrical outer joint shell has at least one first upper and one second conically tapering lower inner wall portion that are respectively offset in the cylinder axis direction (Z), and that a radially inwardly extending projection is provided between the two inner wall portions which preferably extends partially or completely around along the inner wall in the circumferential direction.

In accordance with another advantageous aspect of an example embodiment, the respective conically tapering inner wall portions are situated opposite the conically tapering outer wall portions as viewed in the radial direction.

In accordance with another advantageous aspect of an example embodiment, the elastic elements that are disposed in the bearing gaps are ring-shaped and arranged in the bearing gap so as to extend completely around in the bearing gap.

In accordance with another advantageous aspect of an example embodiment, the force that is required to actuate the receiving cylinder in a cylinder axis direction increases as the clearance decreases due to the relative displacement of said lateral surfaces, and the elastic elements are thereby increasingly compressed and deformed with increasing force.

In accordance with an example embodiment, a wobble chair is provided whose end is fastened in a floor-level joint arrangement in accordance with aspects of example embodiments of the joint arrangement, the lower end thereof being inserted particularly into the hollow cylindrical receiving cylinder.

In accordance with an example embodiment, an assembly method for assembling the parts of a joint arrangement is provided that has the following steps:

a. fastening a first elastic ring-shaped element to the outer lateral surface of the hollow cylindrical receiving cylinder in the vicinity of the conically tapering upper wall portion and
b. fastening a second elastic ring-shaped element to the outer lateral surface of the hollow cylindrical receiving cylinder in the vicinity of the conically tapering lower wall portion, and then
c. inserting the receiving cylinder between the joint shell segments and connecting the joint shell segments by means of connecting means.

Other advantageous aspects of example embodiments of the present disclosure are characterized in the claims and/or depicted in greater detail below together with the description of a preferred embodiment with reference to the figures.

DETAILED DESCRIPTION OF EXAMPLE EMBODIMENTS

Figure 1:
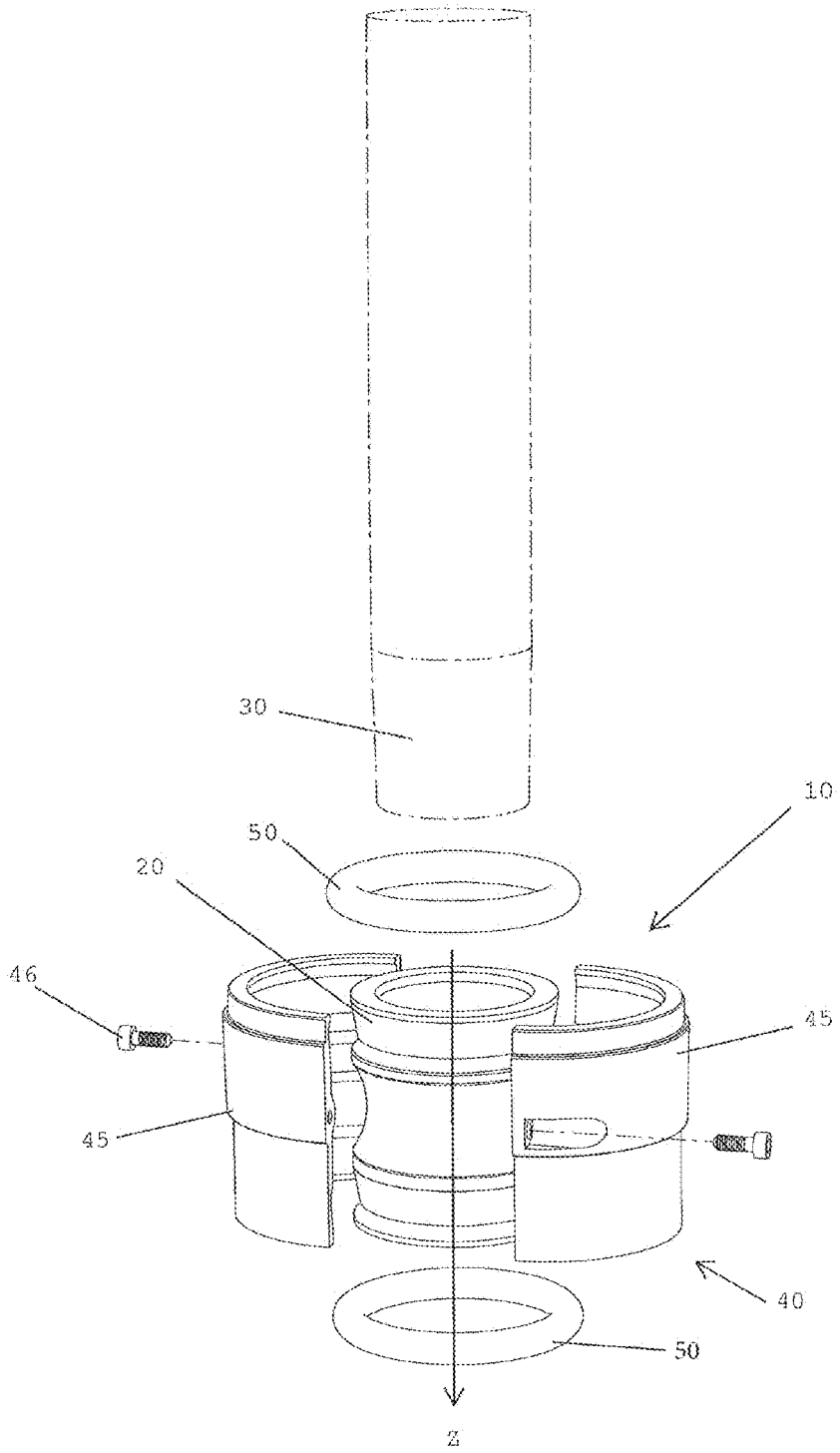
FIG. 1 shows a perspective view of an exemplary embodiment of a joint assembly according to an example embodiment of the invention in an unassembled configuration.

The present disclosure relates to seats, which are also referred to as active-dynamic chairs and are particularly embodied as wobble seats or wobble chairs with a flexible connection between the base and the intermediate portion—here a chair column.

Such mobile or active-dynamic chairs differ from static chairs in that the chair user sitting on the chair is able to perform movements of the torso and body together with the seat part, which is not possible with static chairs. Human physiology prefers dynamic movements to static rest, even when sitting. Chairs that simultaneously support the weight of the legs should not only allow dynamic movement, but also provide ergonomic support for the seat user. In most cases, seating furniture is equipped with appropriately designed seats and backrests in the most anatomically favorable position possible, so that the body, particularly the back, is supported. Such seating furniture is often felt to be comfortable but has the crucial disadvantage that the body only sits passively, meaning that the back muscles are hardly exerted and the intervertebral discs experience a permanent pressure load. Prolonged use of these seating apparatuses can lead to degeneration of the back muscles and wearing of the intervertebral discs. Various harms to health and pain in the back and hip region are a frequent consequence of static or passive sitting. For this reason, active-dynamic seating apparatuses have been developed which enable so-called active-dynamic sitting, in which the back muscles and the intervertebral discs are always slightly in action. This active-dynamic sitting posture is achieved in practically all cases by virtue of the fact that the actual seat of the seating apparatus is held in an unstable, i.e., mobile, position and enables the seat user to swing back and forth from a resting position to a laterally deflected position.

Such an active-dynamic wobble chair is known, for example, from DE 42 44 657 02. That document describes a seating apparatus of this generic type which consists of a base portion, an intermediate piece that is connected to the base portion, and a seat part that is rigidly connected to the intermediate piece, the intermediate piece being held in an opening of the base portion such that it can be tilted in any lateral direction by means of an elastically deformable connecting element and is returned to its neutral position (resting position) in the unloaded state. U.S. Pat. No. 5,921,926 also discloses an active-dynamic wobble chair which is also based on the principle of an inverted pendulum. Such chairs have a defined path of travel and a structural return mechanism while also incorporating a guard to prevent the chair from tipping over. However, when the seat undergoes a pendulum motion toward the rear, it tilts from the horizontal position to an oblique position that points away from the center of the body. Such wobble chairs allow the seat to tilt back and forth from the non-deflected starting position to various deflected positions, whereby the seat tilts from its horizontal position to an oblique position. The tilt angle depends on the direction of the deflection and the degree of the deflection.

EP 0 808 116 B1 describes a self-aligning bearing which is arranged between the column and the base portion. The self-aligning bearing is embodied as an anti-vibration mount and consists of a substantially tubular upper part, the upper end of which is used for the key joint, a lower part that is firmly attached to an arm of the base portion, and an elastic material that is arranged between the upper part and lower part. The self-aligning bearing allows the seat part to swing back and forth.

In principle, however, the pendulum joints of such chairs must have special properties in terms of safety, mobility, restoring force (particularly as a function of the weight of the seat user), and simple technical manufacturability.

Taking the prior art as a point of departure, it is therefore the object of the present disclosure to optimize the aforementioned aspects and provide an active-dynamic chair in which the seat user can perform safe and varied movements of the seat part in a defined range of motion and the pendulum joint is inexpensive to manufacture and has a long service life.

This object is achieved by the combination of features according to claim 1.

According to the disclosure, a joint arrangement is proposed for this purpose which comprises a hollow cylindrical receiving cylinder that extends in the cylinder axis direction and is designed to receive one end of a chair column of an active-dynamic wobble chair, the latter being movably mounted in a substantially hollow cylindrical outer joint shell that is composed of two or more parts made up of joint shell segments, the movable mounting of the receiving cylinder being achieved by means of deformable elastic elements that are arranged so as to be variable in shape and position in a bearing gap between an outer wall portion of the receiving cylinder and an inner wall portion of the joint shell and the receiving cylinder can be actuated in a force-dependent manner, which changes the shape and/or position of the elastic elements as viewed in a radial direction as a result of a change, preferably a reduction, in the clearance of the bearing gap when the receiving cylinder is actuated in a cylinder axis direction.

The concept thus employs oppositely situated outer lateral surfaces of the receiving cylinder that are similarly oriented in terms of their inclination in the cone angle on the one hand and inner lateral surfaces of the bearing shell on the other hand between which a bearing gap is formed to accommodate elastic elements. Due to the translational displacement of the receiving cylinder in the axial direction, the clearance is reduced because the conical lateral surfaces then move toward one another and an elastic element lying therebetween is elastically deformed and possibly displaced along the lateral surface or moved along this surface.

One embodiment of a joint arrangement is therefore especially advantageous in which the movable mounting of the receiving cylinder is achieved by means of deformable elastic elements which are respectively arranged so as to be variable in shape and position in the bearing gap between a conically tapering outer wall portion of the receiving cylinder and a conically tapering inner wall portion of the joint shell and the receiving cylinder can be actuated in a force-dependent manner in a cylinder axis direction, which changes the shape and/or position of the elastic elements as a result of a reduction in the clearance of the bearing gap as viewed in a radial direction (Rs), particularly along the entire circumference.

It is also advantageous if the mentioned conical lateral surfaces extend or are oriented parallel to one another, so that when viewed in translation in the axial direction of the receiving cylinder, the bearing gap therebetween changes in a linear and proportional manner. Alternatively, however, a provision can also be made that the inclination, i.e., the angles of the conical lateral surfaces, is designed to be slightly different in relation to the axial direction of extension.

In one advantageous embodiment, a provision is made that the outer wall of the receiving cylinder has at least one first upper and one second lower wall portion, which are offset in the cylinder axis direction and each of which tapers conically, and that there is preferably a radially constricted wall portion with a smaller diameter between the two wall portions which, preferably as seen in a longitudinal section through the receiving cylinder, has a concave shape.

In another preferred embodiment, a provision is made that the outer wall of the receiving cylinder is preferably also provided at the lower end of the upper concave wall portion with a projection which extends radially outward in the direction of the bearing gap and preferably extends partially or completely around along the outer wall in the circumferential direction and against which abuts an elastic element that is arranged in this region in the bearing gap.

Another advantageous solution is one in which the outer wall of the receiving cylinder is provided at the lower end of the lower concave wall portion with a projection which extends radially outward in the direction of the bearing gap and which preferably extends partially or completely around along the outer wall in the circumferential direction and against which abuts an elastic element that is arranged in this region in the bearing gap.

In another advantageous embodiment, a provision is made that the inner wall of the hollow cylindrical outer joint shell has at least one first upper and one second conically tapering lower inner wall portion that are respectively offset in the cylinder axis direction (Z), and that a radially inwardly extending projection is provided between the two inner wall portions which preferably extends partially or completely around along the inner wall in the circumferential direction. The aforesaid measures with respect to the projections serve the purpose of defining, in particular, end-side limitations in order to limit the translational displacement of both the elastic elements and the receiving cylinder. These projections thus constitute end stops of the bearing.

It is also advantageous if the respective conically tapering inner wall portions are situated opposite the conically tapering outer wall portions as viewed in the radial direction and are relatively offset in their position in the axial direction in order to define the intended and permissible immersion depth of the receiving cylinder in the hollow cylindrical joint shell.

Another advantageous embodiment of the makes a provision that the elastic elements that are disposed in the bearing gaps are ring-shaped and arranged in the bearing gap so as to extend completely around. Ring-shaped elastic rings with a circular or oval-shaped cross section are suitable for this purpose.

It is particularly favorable if the force that is required to actuate the receiving cylinder in a cylinder axis direction increases as the clearance decreases due to the relative displacement of said lateral surfaces, and the elastic elements are thereby increasingly compressed and deformed with increasing force. This is used to automatically change the deflectability of the seat and the chair column in the wobbling direction of such a chair as a function of the weight of the seat user, with the receiving cylinder dipping farther downward into the hollow cylindrical joint shell as the weight of the seat user increases, thereby increasing the deformation of the elastic elements but further limiting the deflection of the wobble chair.

Another aspect of the present disclosure relates to a seat with a chair column whose end is fastened in a floor-level joint arrangement according to an example embodiment of the invention, the lower end thereof being inserted particularly into the hollow cylindrical receiving cylinder.

Another aspect of an example embodiment of the present invention relates to simplified assembly, namely to an assembly method for assembling the parts of a joint arrangement as described, with the following steps:

d. fastening a first elastic ring-shaped element to the outer lateral surface of the hollow cylindrical receiving cylinder in the vicinity of the conically tapering upper wall portion and
e. fastening a second elastic ring-shaped element to the outer lateral surface of the hollow cylindrical receiving cylinder in the vicinity of the conically tapering lower wall portion, and then
f. inserting the receiving cylinder between the joint shell segments and connecting the joint shell segments by means of connecting means.

Other advantageous refinements of an example embodiment of the invention are characterized in the subclaims and/or depicted in greater detail below together with the description of the preferred embodiment of the invention with reference to the figures.

An example embodiment of the invention will be explained in greater detail below with reference to FIGS. 1 to 6, with same reference symbols in the figures indicating same functional and/or structural features.

FIG. 1 shows a perspective view of an exemplary embodiment of a joint arrangement 10 according to an example embodiment of the invention in an unassembled configuration in which the essential individual parts can be seen.

The joint arrangement 10 comprises a hollow cylindrical receiving cylinder 20 which is arranged centrally and extends in a cylinder axis direction Z. In this view, the floor-level part is at the bottom, and a chair column 30 of an active-dynamic wobble chair extends upward and away. The chair column 30 is inserted into the cylindrical receptacle of the receiving cylinder 20, as can be seen in FIGS. 2-5.

Two joint shell segments 45 of a two-part, hollow cylindrical outer joint shell 40 are also shown. The two joint shell segments 45 are connected to one another by connecting means 46, so that the joint shell 40 accommodates the receiving cylinder 20, forming a bearing gap 60, as is shown in FIGS. 2 to 5.

The movable mounting of the receiving cylinder 20 in the joint shell 40 is achieved by means of two deformable, elastic ring elements 50. These are arranged so as to be variable in shape and position in said bearing gap 60 between an outer wall portion 21, 22 of the receiving cylinder 20 and an inner wall portion 41, 42 of the joint shell 40, specifically between a conically tapering outer wall portion 21, 22 of the receiving cylinder 20 and a conically tapering inner wall portion 41, 42 of the joint shell 40.

Figure 2:
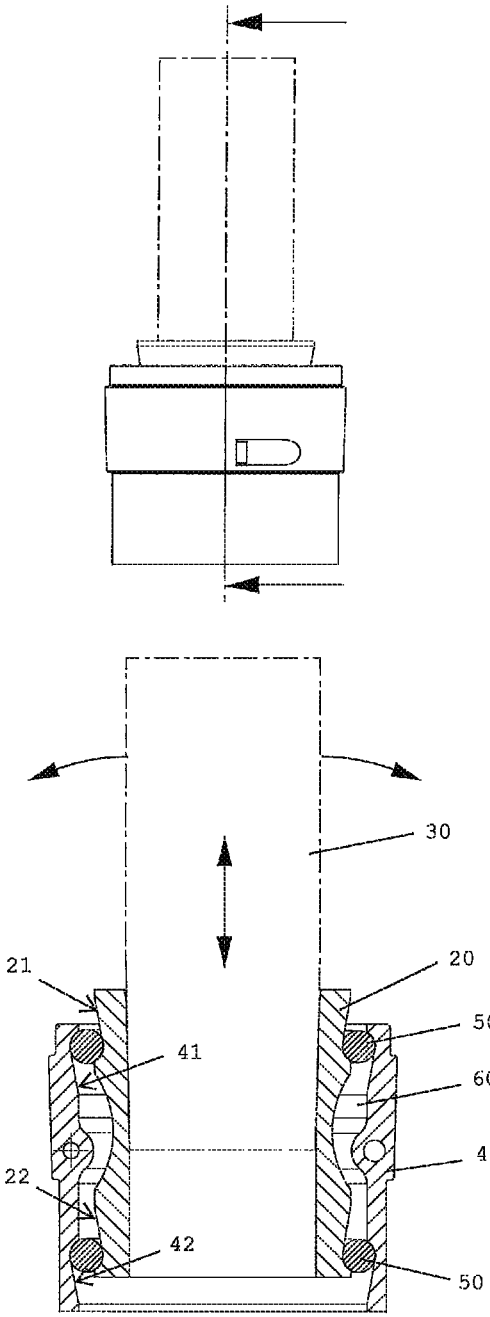
FIG. 2 shows a partial sectional perspective view of a first, non-deflected position of the joint arrangement according to FIG. 1.
Figure 3:
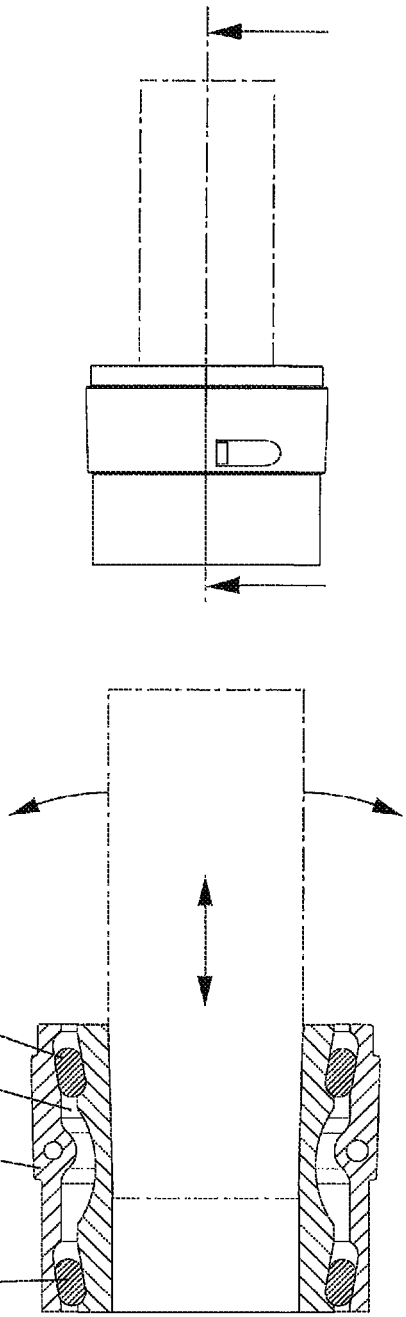
FIG. 3 shows a partial sectional perspective view of a second, specifically vertically loaded position of the joint arrangement according to FIG. 1 in which a force is acting on the pendulum column from above.
Figure 4:
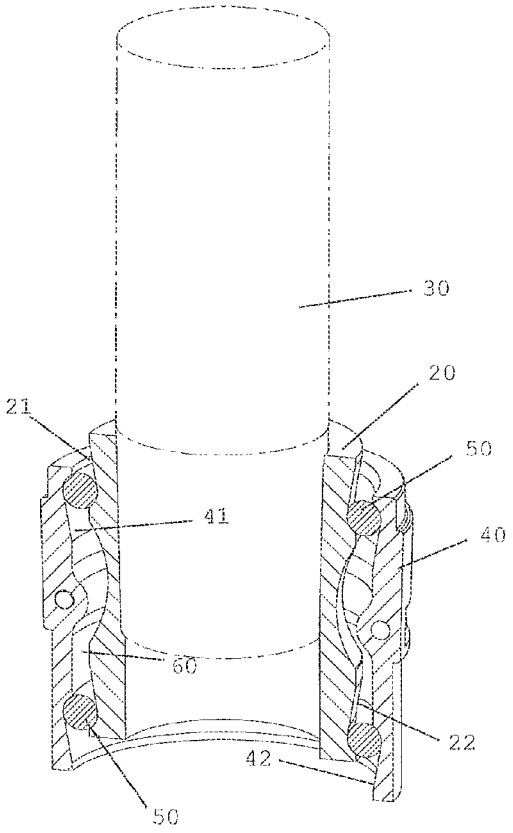
FIG. 4 shows a section through the view according to FIG. 2.
Figure 5:
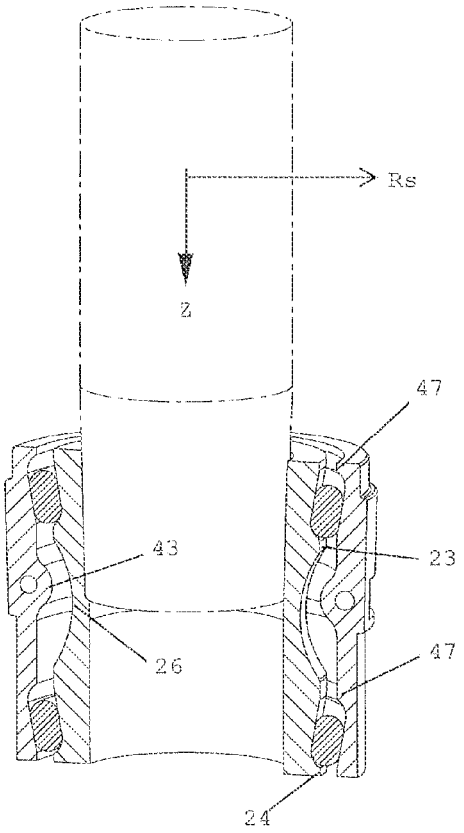
FIG. 5 shows a section through the view according to FIG. 3.

As is shown in FIGS. 3 and 5, the receiving cylinder 20 can be actuated downward from the position shown in FIGS. 2 and 4 as a function of the force. The shape and position of the elastic elements 50 change in the process, as can be seen clearly in FIGS. 3 and 5 in comparison to FIGS. 2 and 4.

FIG. 2 clearly shows the progression of the circumferential bearing gap, in which the clearance changes as a function of the height as viewed in the radial direction Rs but remains constant as viewed in the direction of rotation. In other words, when viewed in the cross-sectional direction, the clearance is constant all the way around, so the separation of the lateral surface is dependent on the difference between the outer diameter of the receiving cylinder 20 in this region and the inner diameter of the joint shell 40 on this sectional plane.

The clearance of the bearing gap 60 decreases in the vicinity of the conical lateral surfaces as viewed in the radial direction (Rs) upon actuation of the receiving cylinder 20 downward in the cylinder axis direction Z. As a result, the elastic ring elements 50 are deformed.

The outer wall of the receiving cylinder 20 has a first, i.e., upper, and a second, i.e., lower, conically tapering wall portion 21 and 22, respectively, which are offset in the cylinder axis direction Z. As can be seen in FIGS. 1 to 5, a radially constricted wall portion 26 with a smaller diameter is provided between the two wall portions 21, 22 and has a concave shape. A projection 43 protrudes from the inner wall surface of the bearing shell 40 toward this concave shape.

At the lower end of the upper concave wall portion 21, the outer wall of the receiving cylinder 20 has a projection 23 that protrudes radially outward in the direction of the bearing gap 60. This is provided in the manner of a ring around the outer wall. The elastic ring element 50 which is arranged in this region in the bearing gap 60 abuts against this projection 23, as can be seen clearly in FIGS. 2 and 3, for example.

Furthermore, a projection 24 which extends radially outward into the bearing gap 60 and also extends completely around along the outer wall in the circumferential direction and against which an additional, namely second elastic ring element 50 is supported which is arranged in the bearing gap 60 in this region is provided on the outer wall of the receiving cylinder 20 at the lower end of the lower concave wall portion 22. Advantageously, the two concave outer lateral surfaces on the receiving cylinder 20 are approximately identical in shape.

As can also be seen from the figures, the inner wall of the hollow cylindrical outer joint shell 40 has a first upper and a second lower inner wall portion 41 and inner wall portion 42, respectively, which are each offset in the cylinder axis direction Z and conically tapered. The aforementioned projection 43 is provided between the two inner wall portions 41, 42 and also extends completely around the inner wall in the circumferential direction. Furthermore, lugs 47 are provided on the joint shell which, in this exemplary embodiment, are arranged so as to extend completely around, but they can also be provided only in sequential portions. These serve as counter-bearings for the elastic elements 50.

Figure 6:
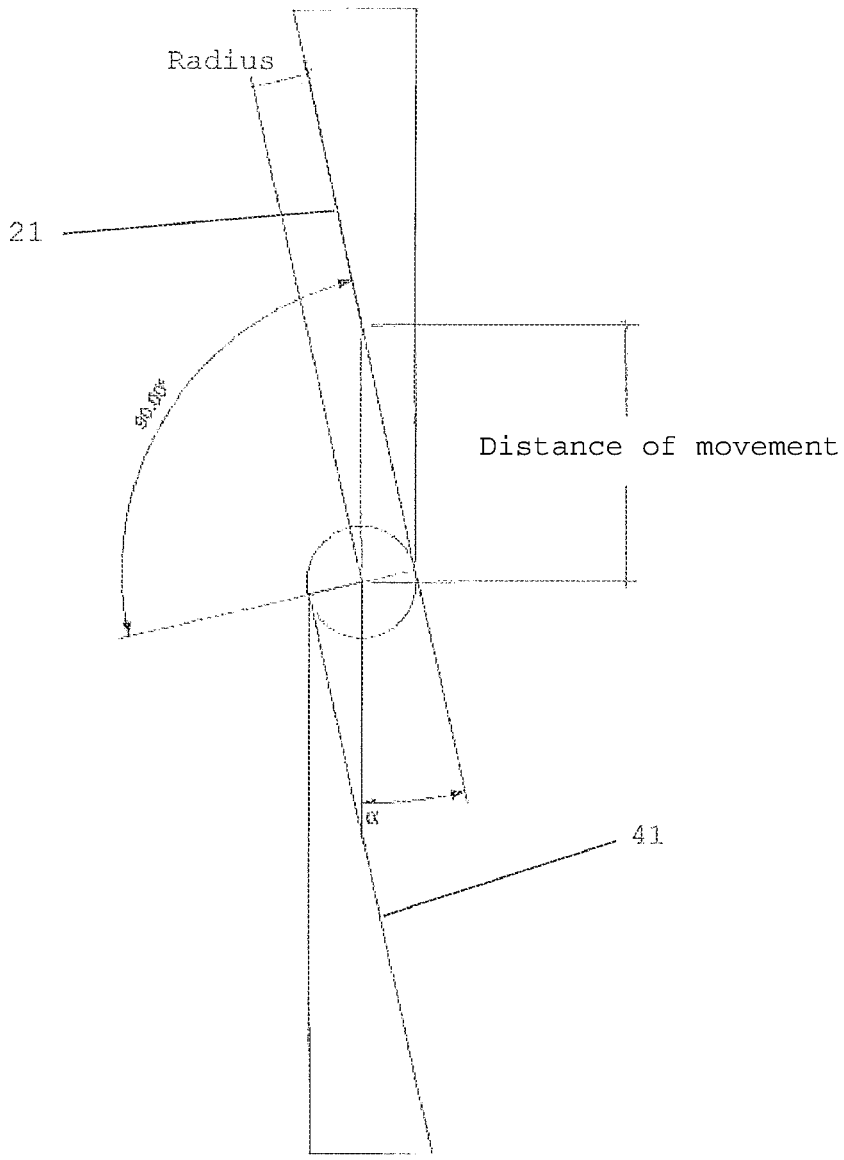
FIG. 6 shows a view elucidating the inclination of the conically tapering lateral surfaces.

FIG. 6 shows a view elucidating the inclination of the conically tapering lateral surfaces. The respective cone angles $\alpha$ relative to the vertical S are equal in amount and constitute alternating angles. The distance between the parallel wall portions corresponds to the diameter D of the elastic ring element 50, which is circular in cross section.

Example embodiments of the disclosure are not limited in execution to the abovementioned preferred exemplary embodiments. Rather, a number of variants are conceivable that make use of the illustrated solution even in the form of fundamentally different embodiments. For instance, the housing shell 40 can be provided with a flange at the lower end in order to attach it to a floor-level stand or base plate.

The invention claimed is:

1. A joint arrangement (10), comprising a hollow cylindrical receiving cylinder (20) that extends in a cylinder axis direction (Z) and is designed to receive one end of a chair column (30) of an active-dynamic wobble chair, the latter being movably mounted in a substantially hollow cylindrical outer joint shell (40) that is composed of two or more parts made up of joint shell segments (45), the movable mounting of the receiving cylinder (20) being achieved by deformable elastic elements (50) that are arranged in a bearing gap (60) between an outer wall portion (21, 22) of the receiving cylinder (20) and an inner wall portion (41, 42) of the outer joint shell (40) and the receiving cylinder (20) can be actuated in a force-dependent manner in a cylinder axis direction (Z), which changes the shape and/or position of the elastic elements (50) as a result of a change, preferably a reduction, in the clearance of the bearing gap (60) as viewed in a radial direction (Rs) when the receiving cylinder (20) is actuated in a cylinder axis direction (Z).

2. The joint arrangement (10) as set forth in claim 1, characterized in that the movable mounting of the receiving cylinder (20) is achieved by deformable elastic elements (50) that are respectively arranged so as to be variable in shape and position in a bearing gap (60) between a conically tapering outer wall portion (21, 22) of the receiving cylinder (20) and a conically tapering inner wall portion (41, 42) of the outer joint shell (40) and the receiving cylinder (20) can be actuated in a force-dependent manner in a cylinder axis direction (Z), which changes the shape and/or position of the elastic elements (50) as a result of a reduction in the clearance of the bearing gap (60) as viewed in a radial direction (Rs), particularly along the entire circumference.

3. The joint arrangement (10) as set forth in claim 1, wherein the outer wall of the receiving cylinder (20) has at least one first upper and one second lower wall portion (21, 22), each of which is offset in the cylinder axis direction (Z) and tapers conically, and that there is a radially constricted wall portion with a smaller diameter between the two wall portions (21, 22) which, as seen in a longitudinal section through the receiving cylinder (20), has a concave shape.

4. The joint arrangement (1) as set forth in claim 1, characterized in that the outer wall of the receiving cylinder (20) is provided at the lower end of the upper concave wall portion (21) with a projection (23) which extends radially outward in the direction of the bearing gap (60) and which preferably extends partially or completely around along the outer wall in the circumferential direction and against which abuts an elastic element (50) that is arranged in this region in the bearing gap (60).

5. The joint arrangement (10) as set forth in claim 1, wherein the outer wall of the receiving cylinder (20) is provided at the lower end of the lower concave wall portion (22) with a projection (24) which extends radially outward in the direction of the bearing gap (60) and which preferably extends partially or completely around along the outer wall in the circumferential direction and against which abuts an elastic element (50) that is arranged in this region in the bearing gap (60).

6. The joint arrangement (1) as set forth in claim 1, characterized in that the inner wall of the hollow cylindrical outer joint shell (40) has at least one first upper and one second conically tapering lower inner wall portion (41, 42) that are respectively offset in the cylinder axis direction (Z), and that a radially inwardly extending projection (43) is provided between the two inner wall portions (41, 42) which preferably extends partially or completely around along the inner wall in the circumferential direction.

7. The joint arrangement (1) as set forth in claim 6, characterized in that the respective conically tapering inner wall portions (41, 42) are situated opposite the conically tapering outer wall portions (21, 22) as viewed in the radial direction.

8. The joint arrangement (1) as set forth in claim 1, characterized in that the elastic elements (50) are ring-shaped and are arranged so as to extend completely around in the bearing gap (60).

9. The joint arrangement (1) as set forth in claim 1, characterized in that the force that is required to actuate the receiving cylinder (20) in a cylinder axis direction increases as the clearance decreases due to the relative displacement of said lateral surfaces, and the elastic elements (50) are thereby increasingly compressed and deformed with increasing force.

10. A wobble chair having a seat with a chair column whose end is fastened in a floor-level joint arrangement (10) according to claim 1, the lower end thereof being inserted particularly into the hollow cylindrical receiving cylinder (20).

11. A method for assembling the parts of the joint arrangement (10) as set forth in claim 1, comprising the following steps:

a. fastening a first elastic ring-shaped element (50) to the outer lateral surface of the hollow cylindrical receiving cylinder (20) in the vicinity of the conically tapering upper wall portion (21) and b. fastening a second elastic ring-shaped element (50) to the outer lateral surface of the hollow cylindrical receiving cylinder (20) in the vicinity of the conically tapering lower wall portion (22), and then c. inserting the receiving cylinder (20) between the joint shell segments (45) and connecting the joint shell segments (45) by a connector (46).

* * * * *